US005180349A

United States Patent [19]

Marcus

[11] Patent Number: 5,180,349

[45] Date of Patent: Jan. 19, 1993

[54] SIMULATED TIGHTROPE WALKING APPARATUS

[76] Inventor: Richard E. Marcus, 1012 King St., Olean, N.Y. 14760

[21] Appl. No.: 728,091

[22] Filed: Jul. 10, 1991

[51] Int. Cl.[5] ..... A63B 7/08

[52] U.S. Cl. ..... 482/34; 482/38; 434/258

[58] Field of Search ..... 482/34, 38, 15, 16; 434/255, 258

[56] References Cited

U.S. PATENT DOCUMENTS

| | | | |
|---|---|---|---|
| 254,215 | 2/1882 | Heeseler | 482/38 |
| 971,003 | 9/1910 | Gilbride . | |
| 2,899,204 | 8/1959 | Ratay | 482/38 |
| 3,944,654 | 3/1976 | Moore | 482/34 |
| 4,258,915 | 3/1981 | Sellge, Jr., et al. | 272/111 |
| 4,378,112 | 3/1983 | Goldstein | 482/34 |
| 4,822,031 | 4/1989 | Olschewski | 482/38 |

FOREIGN PATENT DOCUMENTS

| | | |
|---|---|---|
| 460876 | 4/1975 | U.S.S.R. . |
| 511090 | 6/1976 | U.S.S.R. . |

*Primary Examiner*—Richard J. Apley
*Assistant Examiner*—Lynne Reichard
*Attorney, Agent, or Firm*—Richard M. Rabkin

[57] ABSTRACT

Apparatus for simulating the sag, bounce and side-to-side sway of a tightrope consists of a beam formed by placing one fiberglass tube within another and a pair of spaced support members for supporting the beam at a desired distance above and generally parallel to a horizontal support surface. When a user steps on the beam, the outer tube deflects at a first rate, determined by its mechanical characteristics, until it encounters the smaller diameter inner tube whereupon its resistance to deflection is added to that of the larger tube. The position of the supports may be adjusted along the length of beam to allow the apparatus to be used by persons of different weights.

8 Claims, 1 Drawing Sheet

SIMULATED TIGHTROPE WALKING APPARATUS

BACKGROUND OF THE INVENTION

This invention relates to play equipment and, more particularly, to simulated tightrope walking apparatus.

The desire of a child to try to walk a tightrope after witnessing a high wire act for the first time, has been thwarted by the unavailability of equipment suitable for amateur use. The equipment used in the training of professionals typically includes a major structure for tensioning the rope and supporting it at considerable height above the ground and obviously is outside the reach of beginners and the curious who merely wish to test their ability to walk a tightrope.

The present invention satisfies this need by providing a simple and relatively inexpensive apparatus which closely simulates the bounce and side-to-side sway of a tightrope but does not require a major support structure and which is not so high as to cause injury in case of a fall.

Thus, a primary object of the invention is to provide apparatus for duplicating the bounce and sway characteristics of a tightrope.

Another object is to provide a portable simulated tightrope walking set that is relatively inexpensive and easy to manufacture, and easy to transport and assemble.

Another object of the invention is to provide simulated tightrope apparatus in which the deflection of the "rope" may be adjusted to accommodate the apparatus to users of different weights.

SUMMARY OF THE INVENTION

Briefly, the present invention provides apparatus which simulates the characteristics of a tightrope, such as sag, bounce and sway, comprising a beam consisting of a tube-in-a-tube arrangement of a pair of fiberglass tubes and a pair of support members for supporting the beam at adjusted positions along its length. The outer diameter of the inner tube is sufficiently smaller than the inner diameter of the outer tube that the inner tube, which serves as a stabilizer, is loosely fitted within the outer tube. When the user steps on the "rope" and starts to walk from one end toward the other, the outer tube deflects in response to the person's weight at a rate determined by its dimensions and mechanical properties until it encounters the inner, smaller diameter tube whereupon its resistance to deflection is added to that of the larger outer pipe, behaving much like a rope stretching and then tightening up. The response of the beam to the weight of the user, and his or her movement along the beam, namely, its sag, bounce and sway from side-to-side, is very similar to that of a tightrope supported with tension between end supports. The maximum deflection of the beam is determined by the spacing between the supports, which may be adjusted to avoid having the beam touch the supporting surface; the closer the supports are to one other the stiffer the beam.

Other objects, features and advantages of the invention will become apparent, and its construction and operation better understood, from the following detailed description, read in conjunction with the accompanying drawings.

BRIEF DESCRIPTIONS OF THE DRAWINGS

DETAILED DESCRIPTION OF THE PREFERRED EMBODIMENT

Figure 1:
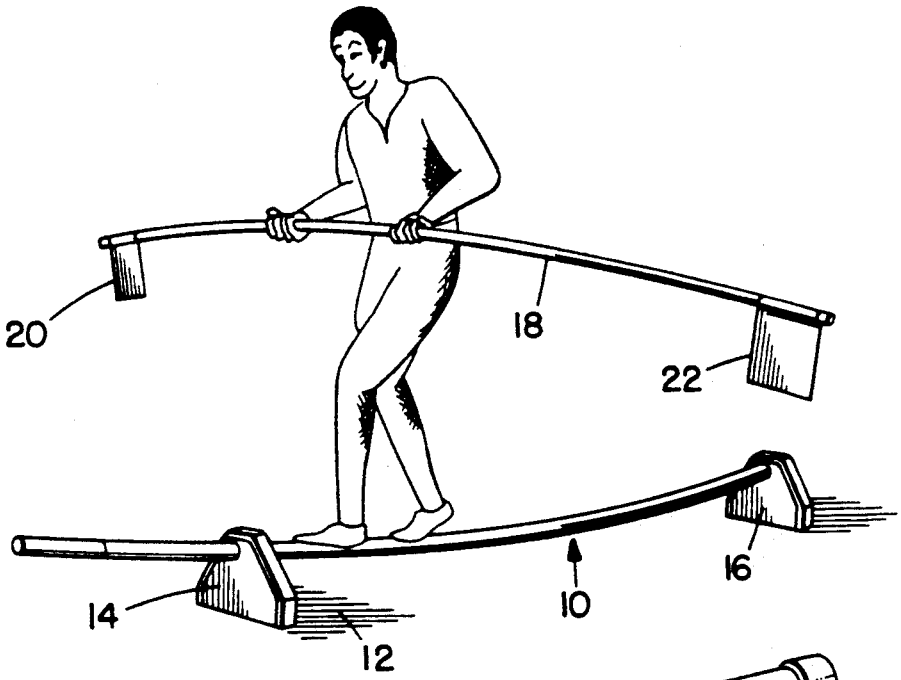
FIG. 1 is a perspective view of simulated tightrope walking apparatus constructed in accordance with the invention, showing how it is used.

As shown in FIG. 1, the simulated tightrope walking apparatus according to the invention consists of a beam 10, which may be of the order of ten to twelve feet in length, supported above a playing surface 12, such as an exercise mat or the ground, on a pair of support members 14 and 16. For most beginners, a balancing pole 18 will be a necessity. A suitable balancing pole, which is not part of the present invention but would be marketed with the beam and the supports as a kit, may be a hollow fiberglass pole, twelve feet long and one inch outside diameter having sand-filled bags 20 and 22 removably attached to the ends of the pole for providing the necessary balancing weight.

Figure 2:
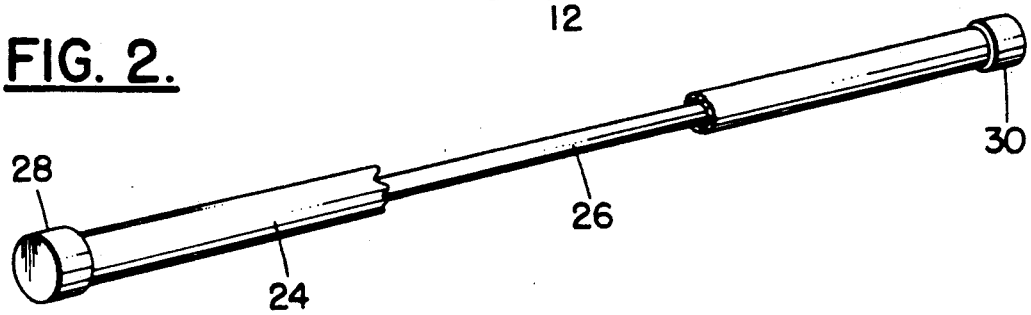
FIG. 2 is a perspective view, partially cut away, showing the tube-in-a-tube construction of the beam.
Figure 3:
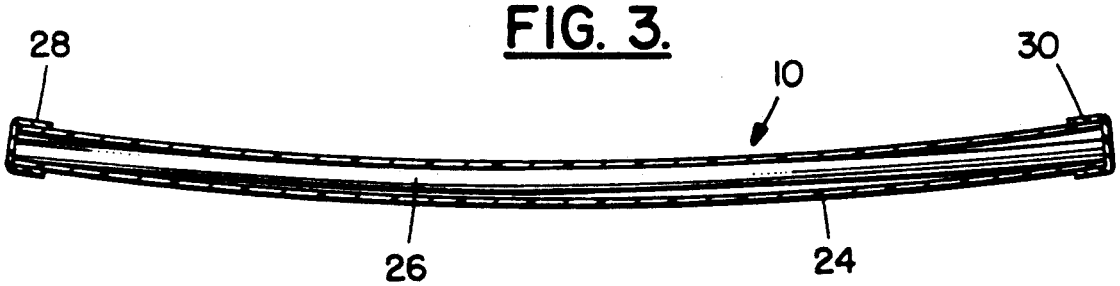
FIG. 3 is a side view of the beam, partially in section, showing how the tubes coact to control the rate of deflection of the beam.
Figure 4:
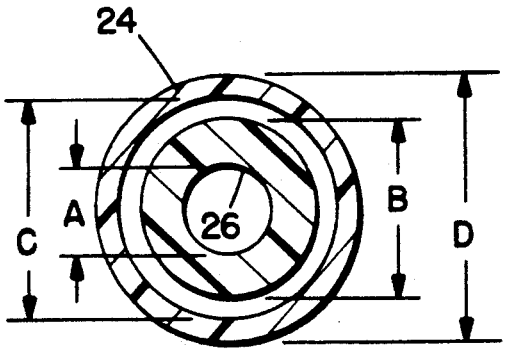
FIG. 4 is an end view of the beam showing the relative diameters of the inner and outer tubes.

As best seen in FIGS. 2, 3 and 4, the "feel" of a tightrope is simulated by a beam consisting of two elongate hollow tubes, preferably made of fiberglass for its tensile strength and flexibility, with one tube 26 loosely fitted within the other 24. In a preferred embodiment the outer tube 24, or main beam, has a circular cross-section and outer and inner diameters D and C of one and one-half inches and one and one-quarter inches, respectively, and the inner tube 26 has an outside diameter B of one inch and an inside diameter A of one-half inch. Because of the approximately one-eighth inch space between the tubes, the inner tube fits loosely within the outer tube. The inner tube 26 is slightly shorter than the other, and rubber caps 28 and 30 are fitted over the ends of the outer tube to keep the inner tube in place and to provide soft protective ends on the outer tube for safety. Alternatively, rubber plugs may be inserted in the outer tube. Fiberglass tubes suitable for constructing the beam are the Series 1500 and 1525 tubes commercially available from Corrosion Resistant Materials Co. of Everett, Pa., which comprise forty to forty-five percent glass having longitudinal and transverse tensile strengths of 30,000 psi and 7,000 psi, respectively; flexural strengths of 30,000 psi and 10,000 psi, respectively; shear strengths of 5,500 psi; and a density in the range from 0.058 to 0.062 pounds per cubic inch.

Figure 5:
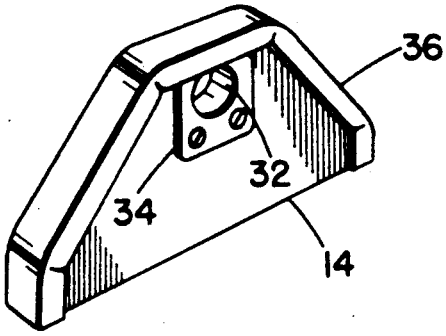
FIG. 5 is a perspective view of a support member.

Referring to FIG. 5, each support member is formed from a generally triangularly shaped block of wood about two inches thick, tapered inwardly from a base width of the order of one foot to its apex, which, for example, may be approximately ten inches above the base. A hole 32 one and three-fourths inches in diameter is drilled through the block near the apex, and to prevent splitting of the block the hole is surrounded by a one-eight inch thick steel plate 34 secured to one side of the wood block. For safety reasons, a strip of foam rubber 36 is secured to the side and top edges of the block.

Assembly of the apparatus is extremely simple, involving only the insertion of the ends of the beam 10 into the reinforced hole 32 of a respective support member, and placing the blocks on a reasonably level and smooth surface. As the outer tube 12 of the beam fits the holes in the support members quite closely, the weight of the user is the only force required to keep the beam in place in the supports.

Typically, the user mounts the beam 10 at one end, near a support, and as he or she steps away from the support and starts to walk toward the other end, the outer tube 24 deflects in response to the user's weight, the rate of deflection depending upon the structural characteristics and dimensions of the tube, until it encounters the smaller diameter inner tube 26. When this occurs, the resistance to deflection of the inner tube 26 is added to that of the outer tube so as to increase the beam's resistance to deflection. The combined action of the tube-in-a-tube construction is much like that of the tightening up of a rope that follows stretching and simulative of the sag, bounce and side-to-side sway of a tightrope. The extent to which the beam deflects depends on the weight of the person performing on the beam, his or her position along the beam, and the spacing between the supports. By way of example, with a spacing of eight feet between the supports, a beam having the described construction deflects three inches when a weight of one hundred ten pounds is applied midway between the supports, and deflects four and one-fourth inches when a weight of one hundred sixty pounds is applied at the midpoint. For a given weight, the deflection increases as the supports are spaced further apart and decreases as they are moved closer together; thus, by adjusting the spacing between the supports, the apparatus can be made to accommodate to a wide range of user weights without having the beam contacting the support surface.

In contrast to the preferred embodiment, a beam consisting of only an outer tube, that is, a fiberglass tube having an outside diameter of one and one-half inches and a wall thickness of one-eighth inch without a stabilizing inner tube, deflects four inches and five and one-half inches, respectively, under weights of one hundred ten and one hundred sixty pounds applied at the midpoint, too much sag and attendant side-to-side sway to be acceptably simulative of a tightrope. Another beam construction comprising a one and one-half inch fiberglass tube stabilized with a wooden pole one and one-quarter inch in diameter likewise fails to acceptably simulate the characteristics of a tightrope; it deflects three and one-half inches and five and one-half inches, respectively, under the same weights applied at the mid-point between supports spaced by eight feet.

While a preferred embodiment of the invention has been shown and described, it will now be apparent to those skilled in the art that changes and modifications may be made without departing from the spirit and scope of the invention. For example, the dimensions of the tubes may differ, within limits, from those specified, and may be constructed from other materials, and the support members, also, may differ in details of construction so long as they are capable of being easily moved along the length of the beam and engage the beam in a manner as not to tend to rock as a performer walks along the beam. The support members may, for example, be formed of metal or a combination of wood and metal, or of high impact plastic material. The appended claims are therefore intended to cover all such changes and modifications as fall within the true spirit of the invention.

I claim:

1. Tightrope simulating apparatus which deflects in response to the weight and movement of a person walking thereon in a manner simulative of a tightrope, said apparatus comprising:

a flexible beam comprising a first elongate circular cylindrical tube having a predetermined inside diameter and a second elongate circular cylindrical tube loosely fitted within said first tube, and first and second support means for supporting said beam above and substantially parallel to a horizontal support surface, at least one of said support means being movable relative to the other to respective spaced apart positions along the length of said beam for adjusting the stiffness of the supported beam, the amount of deflection of said beam in response to a given weight applied to a point on said beam between said support means increasing with increased spacing between said support means.

2. Apparatus as defined in claim 1, wherein said first and second tubes are formed of fiberglass and have diameters and wall thicknesses so related to each other that said first tube initially deflects in response to weight applied to a point thereon between said support means until its inner diameter encounters the outer diameter of said second tube, whereupon the resistance to deflection of said second tube is added to that of said first tube.

3. Apparatus as defined in claim 2, wherein said first tube is slightly longer than said second tube and wherein said apparatus further comprises retaining means fitted to opposite ends of said first tube for retaining said second tube therein.

4. Apparatus as defined in claim 1, wherein said support means comprise a pair of support members each of which is a generally planar structure having a base adapted to be supported on a supporting surface and which extends upwardly therefrom and terminates at an upper end, said structure having an opening therethrough near said upper end of a size to receive said beam and to allow the support member to be moved along the length of the beam.

5. Apparatus as defined in claim 4, wherein said support member is a triangularly-shaped block having a base adapted to be supported on a supporting surface and wherein the beam-receiving opening therethrough is located near the apex of the block.

6. Apparatus as defined in claim 2, wherein said first tube has inner and outer diameters of about 1¼ and 1½ inches, respectively, and said second tube has an outer diameter of approximately 1 inch so as to fit loosely within said first tube for stabilizing said beam by increasing the resistance of the beam to deflection when said first tube encounters said second tube upon being deflected in response to weight applied to said beam at a point between said support means.

7. Tightrope simulating apparatus which deflects in response to the weight and movement of a person walking thereon in a manner simulative of a tightrope, said apparatus comprising:

an elongate beam comprising a first elongate circular cylindrical tube formed of a flexible, high tensile strength material having a predetermined inside diameter and a second elongate circular cylindrical tube, slightly shorter than said first tube, formed of a flexible, high tensile strength material having a predetermined wall thickness and an outside diameter smaller than the inside diameter of said first tube, fitted within said first tube, and retaining means fitted to opposite ends of said first tube for retaining said second tube within said first tube; and first and second support means respectively engaging said beam near opposite ends thereof for supporting said beam above and substantially parallel to a horizontal support surface, at least one of said support means being movable relative to the other to respective spaced apart positions for adjusting the stiffness of the portion of the length of the beam which extends between the adjusted positions of said first and second support means and thus the amount said beam deflects in response to a given weight applied to said beam at a given point between said support means, thereby to accommodate said apparatus to users of different weights and balancing skills.

8. Apparatus as defined in claim 7, wherein said first and second tubes are formed of fiberglass, wherein said first tube has an outer diameter of about 1¼ inches and a wall thickness of about ¼-inch, and wherein said second tube has an outside diameter so as to fit loosely within said first tube for stabilizing said beam by increasing the resistance of the beam to deflection when said first tube encounters said second tube after being initially deflected in response to weight applied to said beam at a point between said first and second support means.

* * * * *